US011063379B2

(12) United States Patent
Gross

(10) Patent No.: US 11,063,379 B2
(45) **Date of Patent: *Jul. 13, 2021**

(54) ELECTRICAL CABLE ASSEMBLY

(71) Applicant: FCI USA LLC, Etters, PA (US)

(72) Inventor: Charles M. Gross, Dillsburg, PA (US)

(73) Assignee: FCI USA LLC, Etters, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/841,491

(22) Filed: Apr. 6, 2020

(65) Prior Publication Data

US 2020/0373692 A1 Nov. 26, 2020

Related U.S. Application Data

(63) Continuation of application No. 15/559,312, filed as application No. PCT/US2016/022465 on Mar. 15, 2016, now Pat. No. 10,615,524.

(Continued)

(51) Int. Cl.
*H01R 12/53* (2011.01)
*H01R 13/514* (2006.01)

(Continued)

(52) U.S. Cl.
CPC ..... *H01R 12/53* (2013.01); *H01R 4/02* (2013.01); *H01R 13/514* (2013.01);

(Continued)

(58) Field of Classification Search
CPC ..... H01R 12/53; H01R 4/023; H01R 12/62; H01R 13/6471; H01R 13/6592; H01R 13/6594; H01R 24/60; H01R 43/28; H01R 9/034; H01R 9/0515; H01R 12/596; H01R 13/514; H01R 13/5845; H01R 13/6585;

(Continued)

(56) References Cited

U.S. PATENT DOCUMENTS 6,428,327 B1 8/2002 Tamarkin et al.
6,832,931 B1 12/2004 Wu (Continued)

FOREIGN PATENT DOCUMENTS

CN 102823070 A 12/2012
CN 103000262 A 3/2013

(Continued)

OTHER PUBLICATIONS

U.S. Appl. No. 15/559,312, filed Sep. 18, 2017, Gross.

(Continued)

*Primary Examiner* — Edwin A. Leon
*Assistant Examiner* — Matthew T Dzierzynski
(74) *Attorney, Agent, or Firm* — Wolf, Greenfield & Sacks, P.C.

(57) ABSTRACT

An electrical cable assembly includes a plurality of electrical cables, and a plurality of interposers configured to be mounted to a substrate at a first end, and mounted to electrical conductors of the electrical cables at a second end that is offset from the first end. The electrical cable assembly further includes an alignment housing that supports the interposers, and further defines a conduit to receive the drain wires of the electrical cables that are mounted to the substrate.

25 Claims, 10 Drawing Sheets

Related U.S. Application Data

(60) Provisional application No. 62/134,845, filed on Mar. 18, 2015.

(51) Int. Cl.
*H01R 4/02* (2006.01)
*H01R 13/58* (2006.01)
*H01R 24/60* (2011.01)
*H01R 107/00* (2006.01)

(52) U.S. Cl.
CPC ..... *H01R 13/5845* (2013.01); *H01R 24/60* (2013.01); *H01R 2107/00* (2013.01)

(58) Field of Classification Search
CPC ..... H01R 13/6658; H01R 2107/00; H01R 9/2416; H01R 12/592; H01R 12/594; H01R 12/722; H01R 12/75; H01R 12/77; H01R 12/775; H01R 13/502; H01R 13/506; H01R 13/5208; H01R 13/567; H01R 13/58; H01R 13/633; H01R 13/642; H01R 13/6461; H01R 13/6466; H01R 13/6474; H01R 13/6586; H01R 13/6593; H01R 13/6599; H01R 13/665; H01R 2103/00; H01R 23/10; H01R 23/688; H01R 23/70; H01R 24/22; H01R 24/30; H01R 24/44; H01R 24/62; H01R 43/0207; H01R 43/0249; H01R 43/20; H01R 43/26; H01R 4/02; H01R 4/027; H01R 4/028; H01R 4/66; H01R 9/03; H01R 9/032; H01R 9/037; H01R 9/05; H01R 9/2483; H05K 2201/10356; H05K 3/3405; H05K 1/117; H05K 3/301
See application file for complete search history.

(56) References Cited

U.S. PATENT DOCUMENTS

| | | | |
|---|---|---|---|
| 7,267,575 | B1 | 9/2007 | Hwang |
| 7,364,465 | B2 | 4/2008 | Wu |
| 7,497,724 | B1 | 3/2009 | Fong et al. |
| 7,507,127 | B2 | 3/2009 | Nagata et al. |
| 7,857,657 | B2 | 12/2010 | Kuwahara et al. |
| 7,906,730 | B2 | 3/2011 | Atkinson et al. |
| 8,011,950 | B2 | 9/2011 | McGrath et al. |
| 8,018,733 | B2 | 9/2011 | Jia |
| 8,235,731 | B1 | 8/2012 | Poulsen et al. |
| 8,840,432 | B2 | 9/2014 | Alden, III et al. |
| 8,845,364 | B2 | 9/2014 | Wanha et al. |
| 8,878,062 | B2 | 11/2014 | Tanaka et al. |
| 8,900,007 | B2 | 12/2014 | Nonen et al. |
| 9,011,177 | B2 | 4/2015 | Lloyd et al. |
| 9,028,281 | B2 | 5/2015 | Kirk et al. |
| 9,231,393 | B2 | 1/2016 | Buck et al. |
| 9,306,334 | B2 | 4/2016 | Zhu et al. |
| 9,373,915 | B1 | 6/2016 | Schulz et al. |
| 9,484,689 | B2 | 11/2016 | Wu et al. |
| 9,545,040 | B2 | 1/2017 | Garman et al. |
| 9,583,887 | B2 | 2/2017 | Xing et al. |
| 9,640,885 | B2 | 5/2017 | Amini et al. |
| 9,705,273 | B2 | 7/2017 | Guetig et al. |
| 9,735,495 | B2 | 8/2017 | Gross |
| 9,741,465 | B2 | 8/2017 | Gross et al. |
| 9,882,293 | B1 | 1/2018 | Chen |
| 9,966,165 | B2 | 5/2018 | Gross et al. |
| 10,103,453 | B2 | 10/2018 | Pao et al. |
| 10,109,937 | B2 | 10/2018 | Zerebilov et al. |
| 10,615,524 | B2 | 4/2020 | Gross |
| 2003/0119343 | A1 | 6/2003 | Lin et al. |
| 2004/0185708 | A1 | 9/2004 | Kuwahara |
| 2007/0111597 | A1 | 5/2007 | Kondou et al. |
| 2009/0176400 | A1 | 7/2009 | Davis et al. |
| 2013/0079609 | A1 | 3/2013 | Besko |
| 2013/0130534 | A1 | 5/2013 | Ohkuma |
| 2013/0188325 | A1* | 7/2013 | Garman ..... H01R 13/6592 361/753 |
| 2014/0191457 | A1 | 7/2014 | Sharma et al. |
| 2018/0115093 | A1 | 4/2018 | Gross |
| 2020/0194911 | A1 | 6/2020 | Ayzenberg et al. |

FOREIGN PATENT DOCUMENTS

| | | | |
|---|---|---|---|
| DE | 3405998 | A1 | 8/1985 |
| JP | 2013-247026 | A2 | 12/2013 |
| WO | WO 2012/122974 | A1 | 9/2012 |
| WO | WO 2013/006592 | A2 | 1/2013 |

OTHER PUBLICATIONS

U.S. Appl. No. 16/716,176, filed Dec. 16, 2019, Ayzenberg et al.
PCT/US2016/022465, dated Jun. 29, 2016, International Search Report and Written Opinion.
PCT/US2016/022465, dated Sep. 28, 2017, International Preliminary Report on Patentability.
International Search Report and Written Opinion for International Application No. PCT/US2016/022465 dated Jun. 29, 2016.
International Preliminary Report on Patentability for International Application No. PCT/US2016/022465 dated Sep. 28, 2017.

* cited by examiner

ELECTRICAL CABLE ASSEMBLY

RELATED APPLICATIONS

This application is a Continuation of U.S. application Ser. No. 15/559,312, filed Sep. 18, 2017, now U.S. Pat. No. 10,615,524, entitled "ELECTRICAL CABLE ASSEMBLY", which is a U.S. National Stage of and claims priority to and the benefit of International Patent Application Number PCT/US2016/022465, entitled "ELECTRICAL CABLE ASSEMBLY" filed on Mar. 15, 2016, which claims priority under 35 U.S.C. § 119(e) to U.S. Provisional Application Ser. No. 62/134,845, entitled "ELECTRICAL CABLE ASSEMBLY" filed on Mar. 18, 2015. The entire contents of these applications are incorporated herein by reference in their entirety.

BACKGROUND

Cable assemblies can be used to electrically connect one electrical component to another electrical component. For instance, electrical cables can extend from an electrical component at a first end, and can be mounted to a printed circuit board at a second end. Conventional shielded electrical cables typically include at least one electrical conductor surrounded by an electrical insulator, and an electrically conductive ground jacket that surrounds the electrical insulator. An exterior electrically insulative layer surrounds both the electrical insulator and an electrically conductive drain wire that extends out from the ground jacket. A portion of the electrical insulator and the electrically insulative layer can be removed from the second end such that the electrical conductor and the drain wire are configured to be mounted to the printed circuit board.

SUMMARY

In accordance with one embodiment, an electrical cable assembly can include at least one electrical cable including at least one electrical conductor, at least one electrically conductive jacket that at least partially surrounds at least a length of the at least one electrical conductor, and at least one drain wire that extends out from the at least one electrically conductive jacket. The electrical cable assembly can further include at least one electrically conductive interposer having a first end that is configured to be mounted to a substrate, and a second end offset from the first end along a longitudinal direction, the second end configured to be mounted to the electrical conductor. The at least one interposer defines an offset between the first and second ends along a transverse direction that is substantially perpendicular to the longitudinal direction.

BRIEF DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
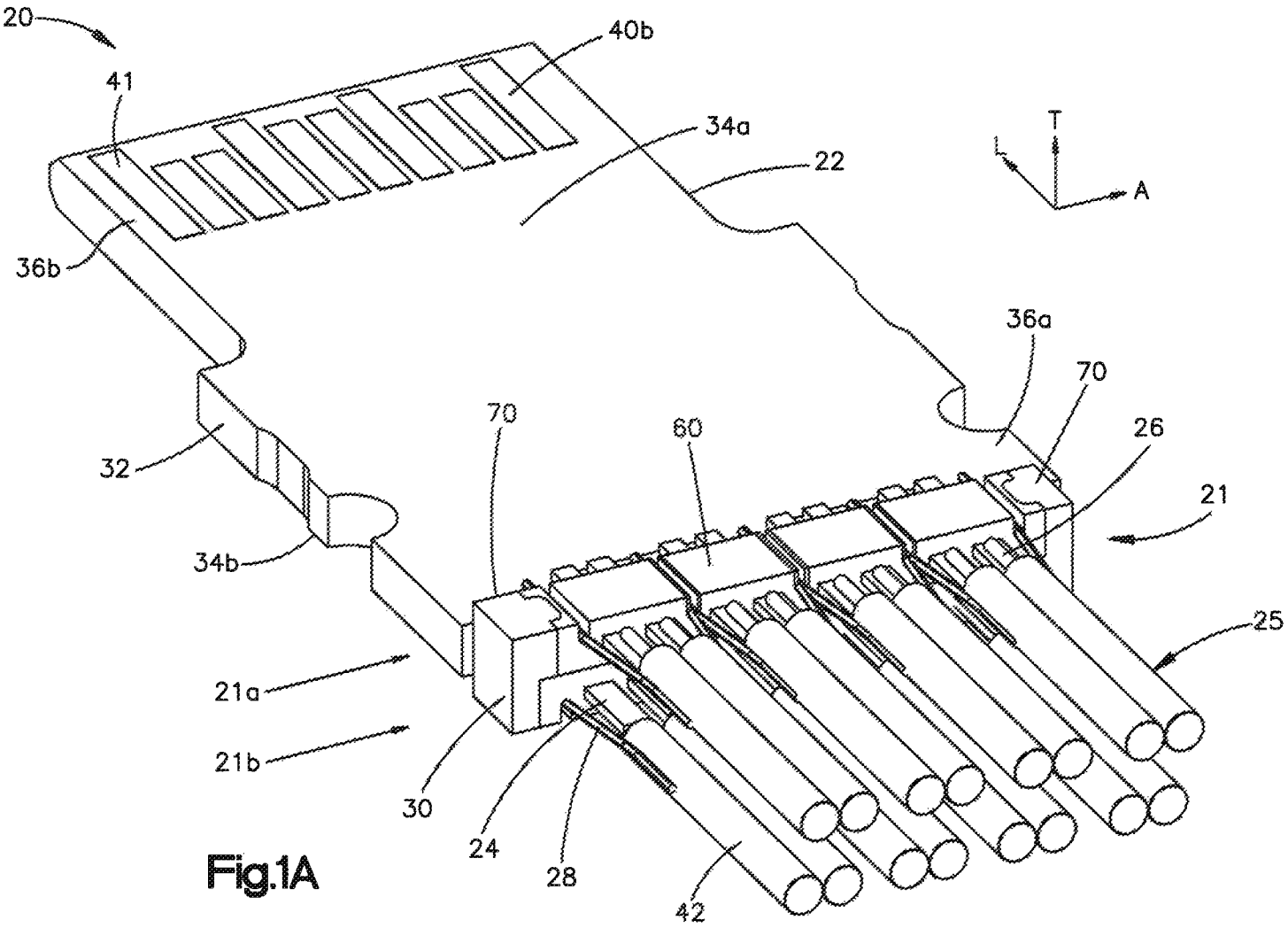
FIG. 1A is a perspective view of an electrical cable assembly constructed in accordance with one embodiment, including a substrate, a plurality of electrically conductive interposers mounted to the substrate, a plurality of electrical cables mounted to the interposers and the substrate, and an alignment housing.
Figure 1B:
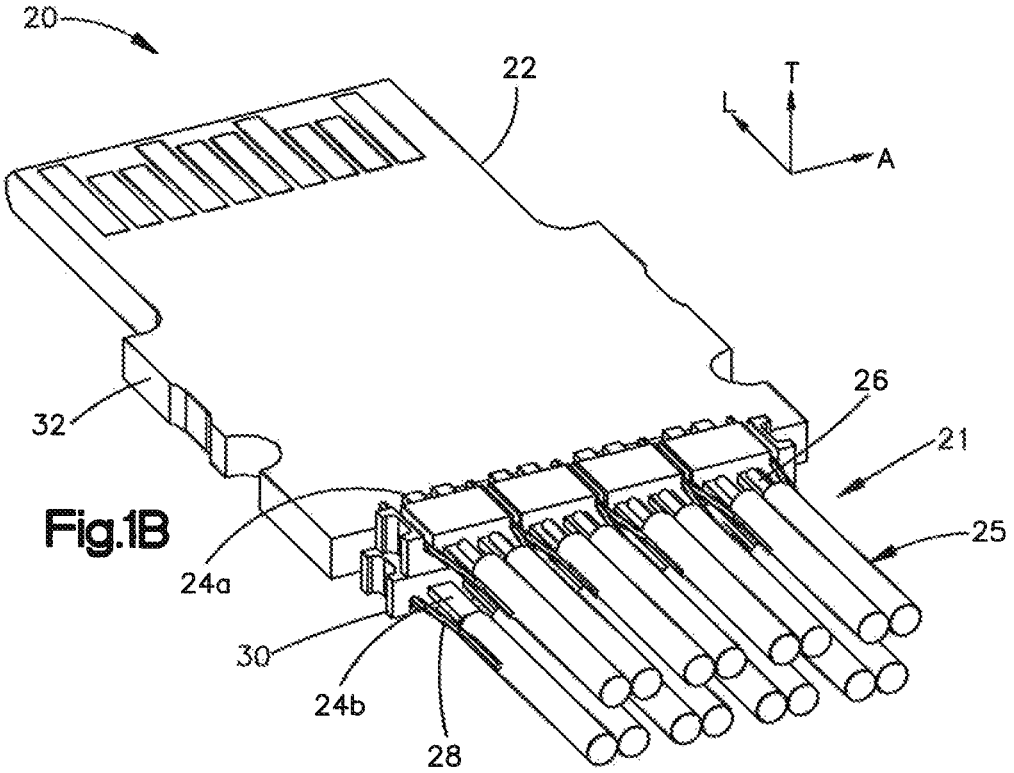
FIG. 1B is perspective view of the electrical cable assembly of FIG. 1A, but showing the alignment housing as transparent.
Figure 1C:
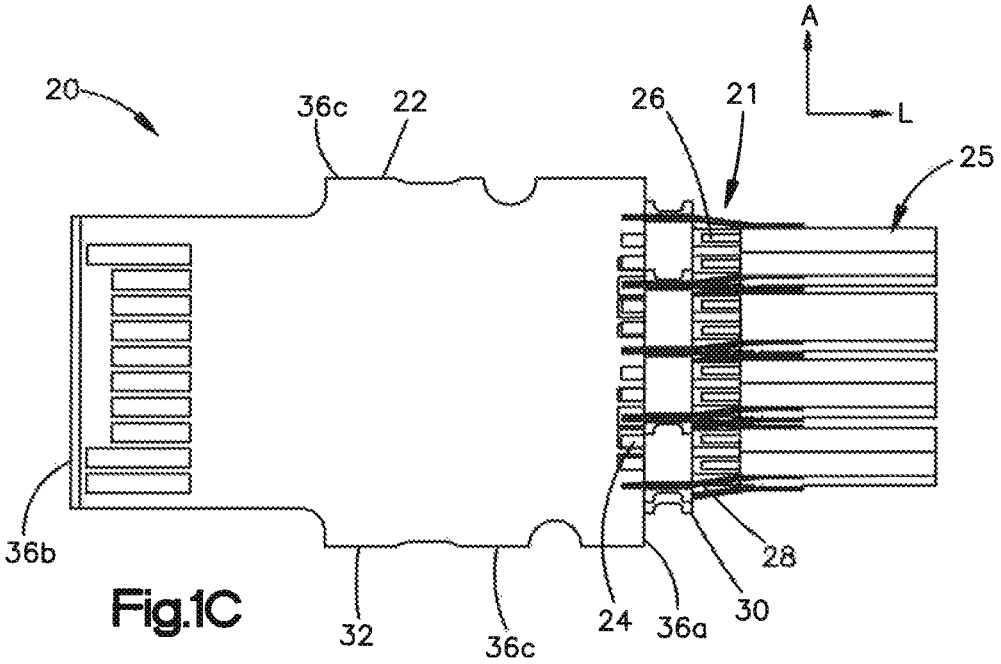
FIG. 1C is a top plan view of the electrical cable assembly as illustrated in FIG. 1B.
Figure 1D:
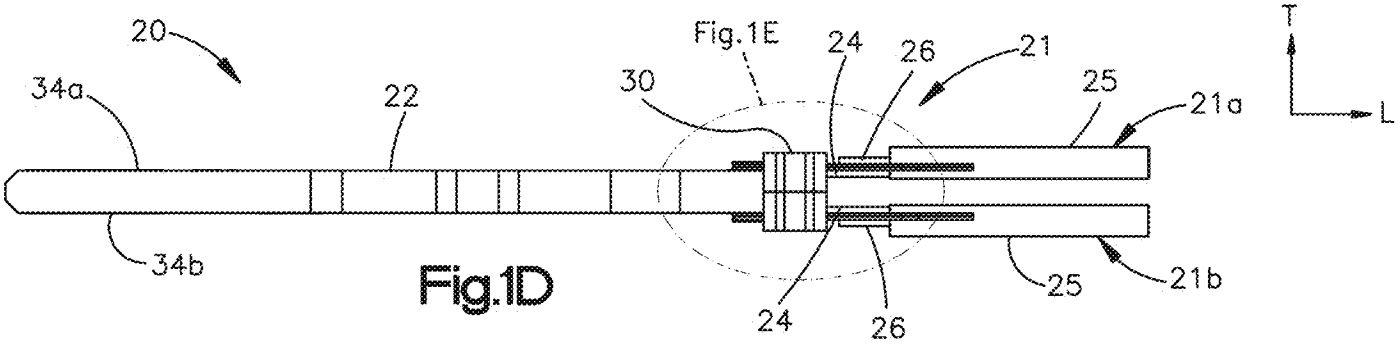
FIG. 1D is a side elevation view of the electrical cable assembly as illustrated in 1B.
Figure 1E:
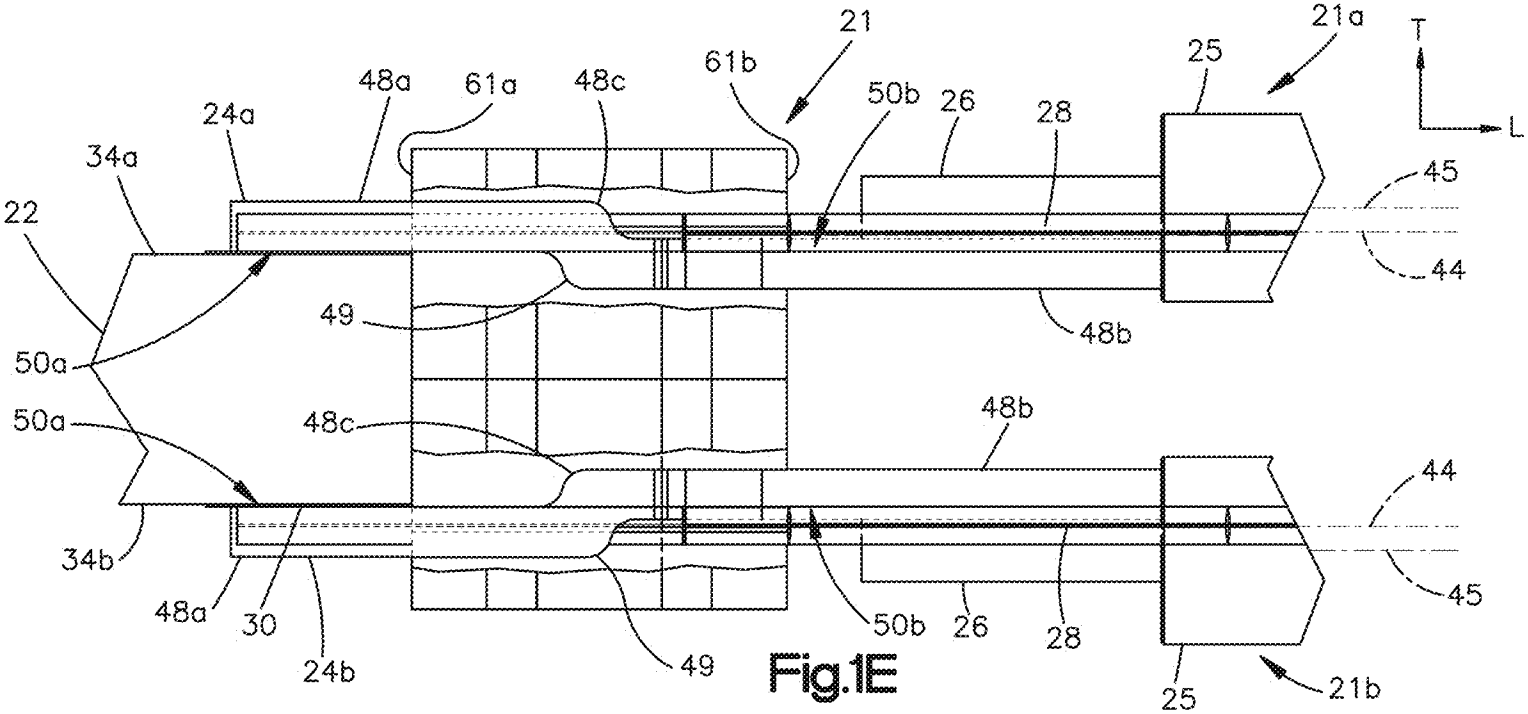
FIG. 1E is an enlarged side elevation view of a portion the electrical cable assembly illustrated in FIG. 1D, taken at region 1E of FIG. 1D, shown with a portion of the housing cut away.

Referring initially to FIGS. 1A-1E, an electrical system 20 can include a substrate 22, which can be configured as a printed circuit board, and at least one electrical cable assembly 21 that is configured to be mounted to the substrate. Each electrical cable assembly 21, and thus the electrical system 20, can include at least one electrically conductive interposer 24, such as a plurality of electrically conductive interposers 24, configured to be mounted to the substrate so as to be placed in electrical communication with respective ones of a first plurality of electrically conductive traces of the substrate 22. Each electrical cable assembly 21, and thus the electrical system 20, can further include an electrical cable 25 that each includes at least one electrical conductor 26 and at least one electrically conductive drain wire 28. The electrical system 20 can include a plurality of electrical cable assemblies and thus a plurality of the interposers 24 and the electrical cables 25. The electrical conductors 26 are configured to be mounted to respective ones of the electrically conductive interposers 24 so as to place the electrical conductors in electrical communication with the respective ones of the first plurality of electrical traces of the substrate 22. The drain wires 28 are configured to be mounted to respective ones of a second plurality of electrically conductive traces of the substrate 22. The electrical cable assembly 21, and thus the electrical system 20, can further include an electrically insulative or dielectric alignment housing 30 that is configured to support the interposers 24 and drain wires 28. For instance, the alignment housing 30 can be configured to receive the interposers 24 and the drain wires. Alternatively, the alignment housing 30 can be overmolded onto one or both of the interposers 24 and the drain wires 28. The interposers 24 and drain wires 28 are configured to extend through the alignment housing 30 so as to be mounted to the respective ones of the first and second pluralities of electrical traces of the substrate 22.

The substrate 22 includes a substrate body 32 that defines a pair of opposed surfaces. For instance, the substrate body 32 defines a first surface 34*a* and an opposed second surface 34*b*. The first surface 34*a* can define an upper surface, and the second surface 34*b* can define a lower surface that is spaced from the upper surface along the transverse direction T so as to define a thickness of the substrate body 32. The substrate body 32 can further define a front end 36*a* that is configured to be placed in electrical communication with the electrical cables 25. The substrate body 32 can further define a rear end 36*b* that is spaced from the front end 36*a* along a longitudinal direction L that is substantially perpendicular to the transverse direction T. The rear end 36*b* can be configured to mate to a complementary electrical component. The substrate body 32 may also define opposed sides 36*c* that extend between the front end 36*a* and the rear end 36*b*, and are spaced from each other along a lateral direction A, that is substantially perpendicular to each of the transverse direction T and the longitudinal direction L. The front end 36*a* can define a front edge of the substrate body 32 that is oriented along the lateral direction A, and the rear end 36*b* can define a rear edge of the substrate body 32 that is oriented along the lateral direction A. The opposed sides 36*c* can define respective side edges of the substrate body 32 that each extend front edge to the rear edge and is oriented along the longitudinal direction. The first surface 34*a* and the second surface 34*b* can both be oriented along a respective plane that is defined by the longitudinal direction L and the lateral direction A.

Figure 3A:
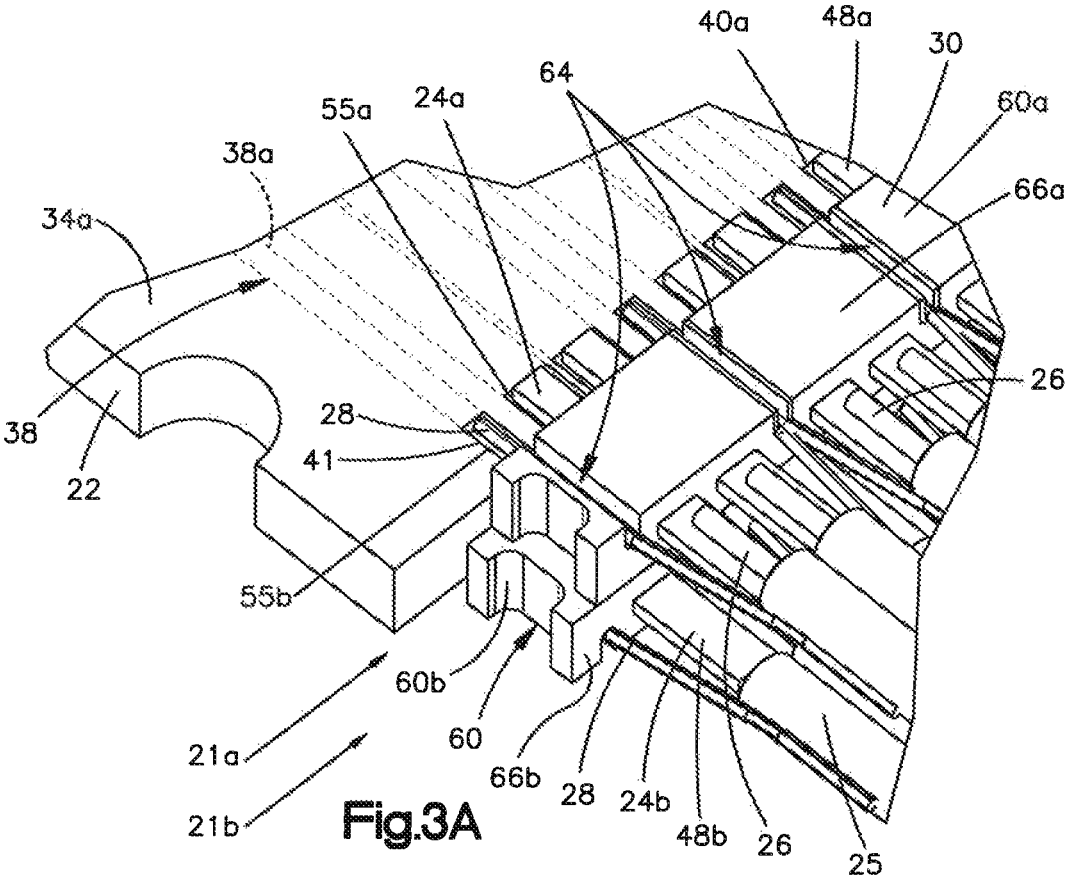
FIG. 3A is an enlarged perspective view of a portion of the electrical cable assembly illustrated in FIG. 1A.
Figure 3B:
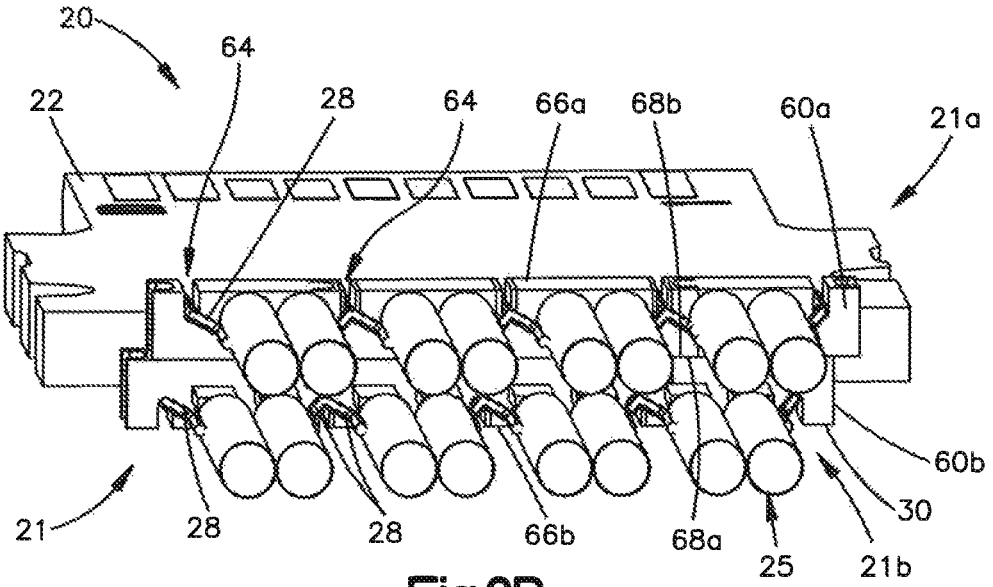
FIG. 3B is another perspective view of a portion of the electrical cable assembly illustrated in FIG. 1A.
Figure 4A:
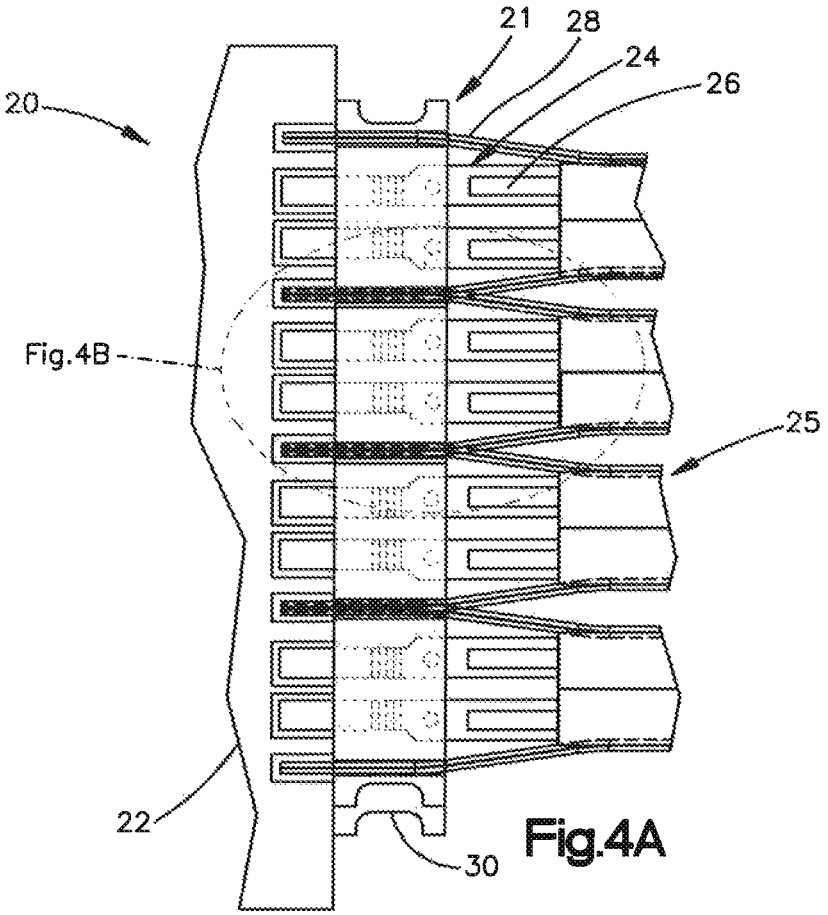
FIG. 4A is a top plan view of the electrical cable assembly illustrated in FIG. 1A, showing the alignment housing as transparent.
Figure 4B:
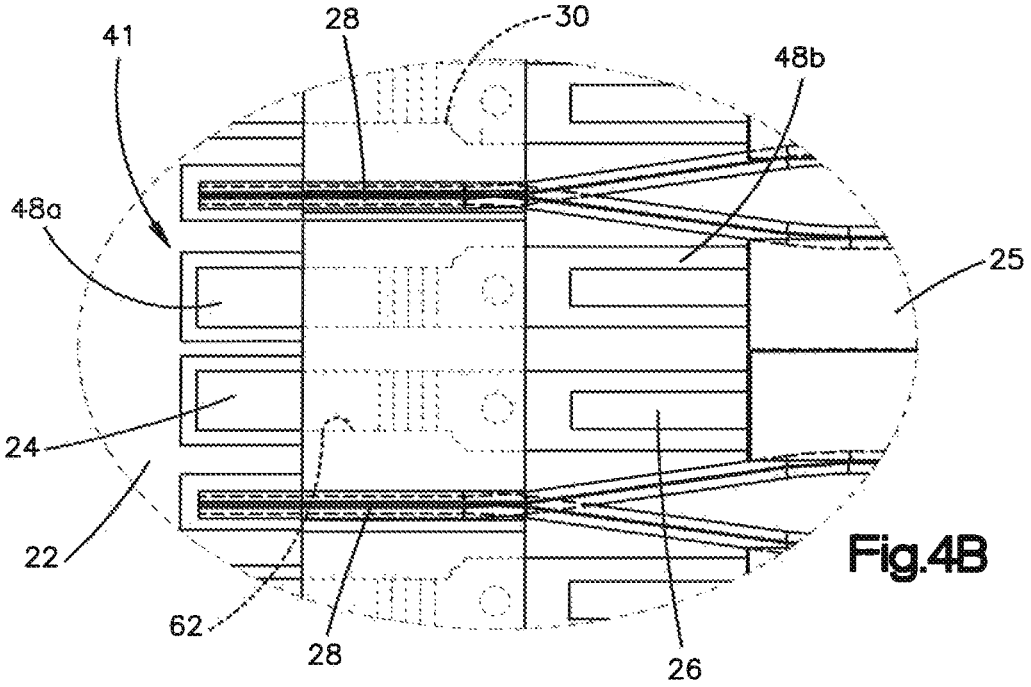
FIG. 4B is a top plan view of a portion of the electrical cable assembly illustrated in FIG. 4A, taken at region 4B of FIG. 4A.

As described above, and with further reference to FIG. 3A, the substrate 22 includes a plurality of electrical traces 38. The electrical traces 38 can include a first plurality of electrical traces 38*a* and a second plurality of electrical traces opposite the first plurality of electrical traces 38*a*. For instance, at least a portion of the electrical traces 38 of the first plurality of electrical traces 38*a* can extend along one of the first and second surfaces 34*a* and 34*b*. Alternatively or additionally, at least a portion of the first plurality of electrical traces 38*a* can extend through the substrate body 32 at a location between the first and second surfaces 34*a* and 34*b*. Each of the first plurality of electrical traces 38*a* can include a first contact location 40*a* and a second contact location 40*b*. The first contact locations 40*a* can be disposed at the front end 36*a* of the substrate body 32, and the second contact locations 40*b* can be disposed at the rear end 36*b* of the substrate body 32. The first contact locations 40*a* can be disposed at the first surface 34*a* of the substrate 22. Accordingly, a first ones 24*a* of the interposers 24 can attach to the first contact locations 40*a* at the first surface 34*a*. Similarly, the second contact locations 40*b* can be disposed at the first surface 34*a* of the substrate 22. The first and second contact locations 40*a* and 40*b* can be configured as electrically conductive contact pads 41 in one example, but it should be appreciated that the contact locations 40*a* and 40*b* can be alternatively configured as desired so as to establish electrical communication with the respective complementary electrical components. The contact pads 41 of the first contact locations 40*a* can be carried by the first surface 34*a* of the substrate 22. Similarly, the contact pads of the second contact locations 40*b* can be carried by the first surface 34*a* of the substrate 22.

At least a portion of the electrical traces 38 of the second plurality of electrical traces can extend the other one of the first and second surfaces 34*a* and 34*b* with respect to the first plurality of electrical traces 38*a*. Alternatively or additionally, at least a portion of the second plurality of electrical traces can extend through the substrate body 32 at a location between the first and second surfaces 34*a* and 34*b*. Each of the second plurality of electrical traces can include a first contact location and a second contact location. The first contact locations can be disposed at the front end 36*a* of the substrate body 32, and the second contact locations can be disposed at the rear end 36*b* of the substrate body 32. The first contact locations can be disposed at the second surface 34*b* of the substrate 22. Accordingly, second ones 24*b* of the interposers 24 can attach to the first contact locations of the second plurality of electrical traces at the second surface 34*b*. Similarly, the second contact locations can be disposed at the second surface 34*b* of the substrate 22. The contact locations of the second plurality of electrical traces can be configured as electrically conductive contact pads 41 in one example, but it should be appreciated that the contact locations can be alternatively configured as desired so as to establish electrical communication with the respective complementary electrical components. The contact pads 41 of the first contact locations can be carried by the second surface 34*b* of the substrate 22. Similarly, the contact pads of the second contact locations can be carried by the second surface 34*b* of the substrate 22.

Figure 2:
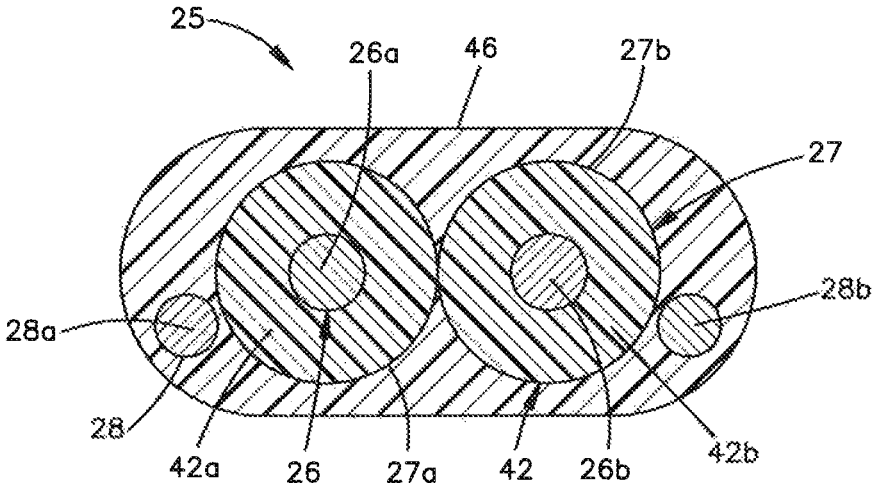
FIG. 2 is a sectional end elevation view of a representative one of the plurality of electrical cables of the electrical cable assembly illustrated in FIG. 1A.

Referring now to FIG. 2, each of the plurality of electrical cables 25 can include at least one electrical conductor 26. For instance, each of the plurality of electrical cables 25 can include a pair of electrical conductors 26 including a first electrical conductor 26*a* and a second electrical conductor 26*b*. The first and second electrical conductors 26*a* and 26*b* can be configured to carry data signals or electrical power. Each of the plurality of cables 25 can further include at least one electrically insulative layer that surrounds the at least one electrical conductor 26. For instance, each of the plurality of cables 25 can include a first inner electrically insulative layer 42*a* that surrounds the first electrical conductor 26*a* and a second inner electrically insulative layer 42*b* that surrounds the second electrical conductor 26*b*. The first and second electrically insulative layers 42*a* and 42*b* surround the respective ones of the first and second electrical conductors 26*a* and 26*b* with respect to a plane that extends along a direction normal to a direction along which the first and second electrical conductors 26*a* and 26*b* are elongate. While the first and second electrically insulative layers 42*a* and 42*b* are illustrated as separate structures, it should be appreciated that they can alternatively be monolithic with each other so long as they electrically insulate the first electrical conductor 26*a* from the second electrical conductor 26*b*, and from any electrically conductive ground jackets as will now be described.

The electrical cables 25 can be shielded. For instance, each of the electrical cables 25 can include at least one electrically conductive ground jacket 27. In particular, the at least one electrically conductive ground jacket 27 can at least partially surround at least a length of the at least one electrical conductor 26. The ground jacket 27 can be configured as a foil or braid or alternative suitable ground jacket 27. The ground jacket 27 can surround respective ones or both of the first and second electrical conductors 26*a* and 26*b*. For example, the at least one ground jacket 27 can surround the electrically insulative layers 42*a* and 42*b*. The ground jacket 27 can be placed in electrical communication with an electrical ground member of the substrate 22 to which the electrical cable 25 is mounted. For instance, each of the electrical cables 25 can further include at least one electrically conductive drain wire 28 that is configured as an electrical ground conductor that can extend out from the at least one electrically conductive ground jacket 27.

In one example, the electrical cable 25 includes a first ground jacket 27*a* that surrounds the first electrical conductor 26*a*, and a corresponding first drain wire 28*a* that extends out from the first ground jacket 27*a*. Similarly, the electrical cable 25 includes a second ground jacket 27 that surrounds the second electrical conductor 26*b*, and a corresponding second drain wire 28*b* that extends out from the second ground jacket 27*b*. As described above, the first electrically insulative layer 42*a* can be disposed between the first electrical conductor 26*a* and the first ground jacket 27*a*. Similarly, the second electrically insulative layer 42*b* can be disposed between the second electrical conductor 26*b* and the second ground jacket 27*b*. The ground jackets 27*a* and 27*b* can be in electrical communication with each other or electrically isolated from each other. The electrical cables 25 can alternatively include a single drain wire 28 that extends out from either of the first and second ground jackets 27*a* and 27*b*, for instance when the first and second ground jackets 27*a* and 27*b* are in electrical communication with each other. Alternatively, as will be illustrated in FIGS. 8A-8B, the electrical cable 25 can include a ground jacket 27 that surrounds both the first and second electrical conductors 26*a* and 26*b*, and in particular can surround both electrically insulative layers 42*a* and 42*b*. The electrical cable can thus include a single drain wire 28 that extends out from the ground jacket 27. Alternatively still, as illustrated in FIG. 8C, the electrical cable can include a single electrical conductor 26, a single inner electrically insulative layer 42 that surrounds the first electrical conductor 26, a single ground jacket 27, and a single drain wire 28 that extends out from the ground jacket 27.

Each of the plurality of cables 25 can further include an exterior electrically insulative layer 46 that surrounds the respective at least one ground jacket 27, and the at least one inner electrically insulative layer 42. The exterior electrically insulative layer 46 can further surround at least a portion of the at least one drain wire 28. The exterior insulative layer 46 can reduce the crosstalk imparted by the respective electrical cable 25 to others of the plurality of electrical cables 25. The electrically insulative layers 42*a* and 42*b*, and the exterior insulative layer 46 can be constructed of any suitable dielectric material, such as a plastic. The at least one electrical conductor 26 and the at least one drain wire 28 can be constructed of any suitable electrically conductive material, such as copper.

Each drain wire 28 can be offset with respect to the respective at least one electrical conductor 26 along the transverse direction T. For instance, the drain wire 28 can extend along a central drain wire axis 44. The central drain wire axis 44 can be defined at a location where the respective drain wire 28 is mounted to the substrate 22. Similarly, the at least one electrical conductor 26 can extend along a respective central conductor axis 45. The central conductor axis 45 can be also be defined at a location where the electrical conductor 26 is mounted to the respective one of the interposers 24. The location of the central conductor axis 45 can be radially aligned with the location of the central drain wire axis 44. The central drain wire axis 44 and the central conductor axis 45 can be offset along the transverse direction T.

Referring again to FIGS. 1A-1E, and as described above, the electrical system 20 can include a plurality of electrical cable assemblies 21. Each electrical cable assembly 21 can include a respective one of the electrical cables 25, and a respective at least one of the interposers 24 that is configured to be placed in electrical communication with both the substrate 22 and a respective one of the at least one electrical conductor 26 of the electrical cable 25. For instance, in embodiments whereby the electrical cables 25 include a single electrical conductor 26, the electrical cable assembly 21 can include a single interposer 24 that is configured to be placed in electrical communication with both the substrate and the electrical conductor 26. In embodiments whereby the electrical cables 25 include a plurality (which can include a pair) of electrical conductors 26, the electrical cable assembly 21 can include a corresponding plurality of interposers 24 that are configured to be placed in electrical communication with both the substrate 22 and respective ones of the plurality of electrical conductors 26. For instance, as will now be described, each of the interposers 24 is configured to be mounted to the substrate 22 at a first end 48*a*, and mounted to the respective electrical conductor 26 at a second end 48*b*, thereby placing the respective electrical conductor in electrical communication with the substrate 22.

The electrical cables 25 and the interposers 24 can be arranged in at least one row that can be oriented along the lateral direction A. For instance, respective first ones of the electrical cables 25 and the interposers 24 can be arranged in a first row 21*a*, and respective second ones of the electrical cables 25 and the interposers 24 can be arranged in a second row 21*b*. The first row 21*a* and the second row 21*b* can be spaced from each other along the transverse direction T that is substantially perpendicular to the lateral direction A. The electrical cables 25 of the first row 21*a* can be aligned with respective ones of the electrical cables 25 of the second row 21*b*, or can be staggered with respect to the electrical cables 25 of the second row 21*b* along the lateral direction A. The first row 21*a* can thus include the first ones 24*a* of the plurality of interposers 24. The second row 21*b* can include the second ones 24*a* of the plurality of interposers 24.

Referring now to FIGS. 3A-4B, and as described above, the electrical system 20 can include a plurality of electrically conductive interposers 24 that are each configured to be mounted to the substrate 22 and further configured to be placed in electrical communication with respective ones of the electrical conductors 26 of the plurality of electrical cables 25. Thus, the interposers 24 are configured to individually place the electrical conductors 26 in electrical communication with the substrate 22. For instance, each of the interposers 24 can define a first end 48*a*, a second end 48*b*, and an intermediate region 48*c* that extends from the first end 48*a* to the second end 48*b*. The first end 48*a* is offset from the second end 48*b* along the longitudinal direction L. The first end 48*a* is configured to be mounted to a respective one of first contact locations 40*a*, and the second end 48*b* is configured to be mounted to a respective one of the electrical conductors 26.

Each of the interposers 24 can define a first width at the first end 48*a* along the lateral direction A, and a second width at the second end 48*b* along the lateral direction A that is different than the first width. For instance, the second width can be greater than the first width. Further, first end 48*a* can be offset from the second end 48*b* along the transverse direction T. For instance, the intermediate region 48*c* can define a transition region 49 that offsets that first end 48*a* and the second end 48*b* with respect to each other along the transverse direction. The first end 48*a* extends from the transition region 49 along a first direction, and the second end 48*b* can extend from the transition region 49 along a second direction opposite the first direction. For instance, the first and second directions can be oriented along the longitudinal direction. In this regard, the first end 48*a* can be oriented parallel to the second end 48*b*. It should be appreciated, however, that the first and second ends 48*a* and 48*b* can be oriented nonparallel to each other. The transition region 49 can include a first bend at a first interface between the intermediate region 48*c* and the first end 48*a*. Thus, the first end 48*a* can extend out along the first direction from the first bend. The transition region can include a second bend at a second interface between the intermediate region 48*c* and the second end 48*b*. Thus, the second end 48*b* can extend out alone the second direction from the second bend. The first and second bends can define one or more radii. Alternatively or additionally, the first and second bends can define one or more angles.

Each of the interposers 24 can define a first surface 50*a* and a second surface 50*b* opposite the first surface 50*a*. The first and second surfaces 50*a* and 50*b* can run parallel to each other. The first surface 50*a* at the first end 48*a* can define a first engagement surface that is configured to be mounted to the substrate 22. Thus, the first engagement surface can be configured to face a transverse inward direction toward the substrate 22. Accordingly, the first engagement surface is configured to face the substrate 22. The transverse inward direction can be oriented substantially along the transverse direction T, or a direction that includes the transverse direction T. In one example, the first engagement surface can be substantially planar so as to be in surface-to-surface arrangement with the respective one of the contact pads 41 of the substrate 22. In the surface-to-surface arrangement, the first engagement surface can be oriented substantially parallel to the substrate. The term "substantially" as used herein can account for manufacturing tolerances. In one example, the first ends 48*a* of the interposers 24 can be soldered to the contact pads 41, thought it should be appreciated that the first ends of the interposers 24 can be mounted to the substrate 22 in accordance with any suitable alternative embodiment as desired.

The transverse inward direction, as used herein with respect to an element that is mounted to one of the first and second surfaces 34*a* and 34*b* of the substrate 22, can refer to a direction oriented along the transverse direction toward the other of the first and second surfaces 34*a* and 34*b* of the substrate 22. The transverse inward direction, as used herein with respect to an element that is spaced from the substrate 22, can refer to a direction oriented along the transverse direction T either toward the substrate 22, or toward a transverse midplane of the substrate 22. The transverse midplane of the substrate 22 is positioned equidistantly between the first and second surfaces 34*a* and 34*b*. The transverse inward direction, as used herein with respect to one of the first and second rows 21*a* and 21*b*, can refer to a direction oriented along the transverse direction T toward the other of the first and second rows 21*a* and 21*b*.

The second surface 50*b* at the second end 48*b* can define a second engagement surface that is configured to be mounted to a respective one of the electrical conductors 26. Thus, the second engagement surface can be configured to face a transverse outward direction toward the respective one of the electrical conductors 26. The transverse outward direction can be oriented substantially along the transverse direction T, and can be substantially opposite the transverse inward direction. Thus, the second engagement surface is configured to face the respective one of the electrical conductors 26. The second engagement surface can be substantially planar. For instance, the second engagement surface can be substantially planar along a plane defined by the longitudinal direction L and the lateral direction A. It should be appreciated, however, that the first and second engagement surfaces can be alternatively shaped as desired.

As described above, the first and second ends 48*a* and 48*b* can be offset with respect each other. For instance, the first end 48*a* can be offset with respect to the second end 48*b* in the transverse inward direction T. In one example, the first end 48*a* can be mounted to one of the first and second surfaces 34*a* and 34*b* of the substrate 22, and the second end 48*b* can be offset with respect to the first end 48*a* in a direction toward the other of the first and second surfaces 34*a* and 34*b* of the substrate 22. The first and second ends 48*a* and 48*b* can be offset any distance as desired with respect to the transverse direction T. For instance, the first and second ends 48*a* and 48*b* can be offset such that the first surface 50*a* can be disposed between the first and second surfaces 34*a* and 34*b* of the substrate 22 with respect to the transverse direction T. The offset of the first end 48*a* with respect to the second end 48*b* can be less than a transverse thickness of the substrate 22 from the first surface 34*a* to the second surface 34*b*. For instance, the offset of the first end 48*a* with respect to the second end 48*b* can be less than one-half the transverse thickness of the substrate 22 from the first surface 34*a* to the second surface 34*b*.

Each of the interposers 24 can define a thickness along a direction normal to the interposer 24 from the first surface 50*a* to the second surface 50*b*. The first and second ends 48*a* and 48*b* can be offset from each other along the transverse direction a distance substantially equal to the thickness of the interposer 24 along the transverse direction T. Accordingly, the first engagement surface can be substantially coplanar with the second engagement surface with respect to a plane that is oriented in the longitudinal direction L and the lateral direction A. In one example, the first and second engagement surfaces can be aligned with each other along the lateral direction.

Alternatively, the first and second engagement surfaces can be offset with respect to each other along the transverse direction T. In one example, the offset is less than the difference of the transverse thickness of the substrate 22, and the thickness of the interposer 24. For instance, the offset can be less than the difference of one-half the transverse thickness of the substrate 22 and the thickness of the interposer 24. It should be further appreciated that the first surface 50*a* of the interposer 24 at the first end 48*a* can be offset from the first surface 50*a* at the second end 48*b*. In one example, the offset of the first surface 50*a* can be less than the transverse thickness of the substrate 22. For instance, the offset of the first surface 50*a* can be less than one-half the transverse thickness of the substrate 22. Similarly, it should be further appreciated that the second surface 50*b* of the interposer 24 at the first end 48*a* can be offset from the second surface 50*b* at the second end 48*b*. In one example, the offset of the second surface 50*b* can be less than the transverse thickness of the substrate 22. For instance, the offset of the second surface 50*b* can be less than one-half the transverse thickness of the substrate 22.

As described above, the first row 21*a* of the electrical cable assemblies 21 can include first ones 24*a* of the interposers 24, and the second row 21*b* of the electrical cable assemblies 21 can include second ones 24*b* of the interposers 24. The first ones 24*a* of the interposers 24 are configured to be mounted to the first surface 34*a* of the substrate 22, for instance at the respective first engagement surfaces. The second ones 24*b* of the interposers 24 are configured to be mounted to the second surface 34*b* of the substrate 22, for instance at the respective first engagement surfaces. When the first and second ones 24*a* and 24*b* of the interposers 24 are mounted to the substrate 22, the transverse inward direction of the first engagement surfaces of the second ones 24*b* of the interposers 24 can be opposite the transverse inward direction of the first engagement surfaces of the second ones 24*a* of the interposers 24. Thus, the first engagement surfaces of the first ones 24*a* of the interposers 24 can face a first direction, and the first engagement surfaces of the second ones 24*b* of the interposers 24 can face a second direction opposite the first direction. The first and second directions can, for instance, extend toward each other from the respective first engagement surfaces. The transverse outward direction of the second engagement surfaces of the second ones 24*b* of the interposers 24 can be opposite the transverse outward direction of the second engagement surfaces of the first ones 24*a* of the interposers 24. Thus, the second engagement surfaces of the first ones 24*a* of the interposers 24 can face the second direction, and the first engagement surfaces of the second ones 24*b* of the interposers 24 can face the first direction that is opposite the second direction. The first and second directions can, for instance, extend away from each other from the respective second engagement surfaces. For instance, the first and second ones 24*a* and 24*b* of the interposers 24 can be oriented as mirror images of each other with respect to a plane that is oriented along the longitudinal direction L and the lateral direction A. The plane can be defined by the midplane of the substrate 22.

Referring again to FIGS. 1A-1E, and as described above, the drain wires 28 of the electrical cables 25 can be offset with respect to the electrical conductors 26 of the electrical cables 25 along the transverse direction T. For instance, the electrical cables 25 can be oriented such that the drain wires 28 are offset in the transverse inward direction with respect to the electrical conductors 26. Thus, the central drain wire axes 44 of the drain wires 28 of the first and second rows 21*a* and 21*b* can be disposed between the central conductor axes 45 of the electrical conductors 26 of the first and second rows 21*a* and 21*b* with respect to the transverse direction T. For instance, the central drain wire axes 44 of the drain wires 28 of the first row 21*a* can be aligned in a first plane, the central drain wire axes 44 of the drain wires 28 of the second row 21*b* can be aligned in a second plane, the central conductor axes 45 of the electrical conductors 26 of the first row 21*a* can be aligned in a third plane, and the central conductor axes 45 of the electrical conductors 26 of the second row 21*b* can be aligned in a fourth plane. The first and second planes can be disposed between the third and fourth planes. As a result, the electrical cables 25 can be oriented in a first orientation such that the central conductor axes 45 of the electrical conductors 26 of the first row 21*a* are spaced from the central conductor axes 45 of the electrical conductors 26 of the second row 21*b* a first distance. The first distance can be measured along the transverse direction T.

Figure 5A:
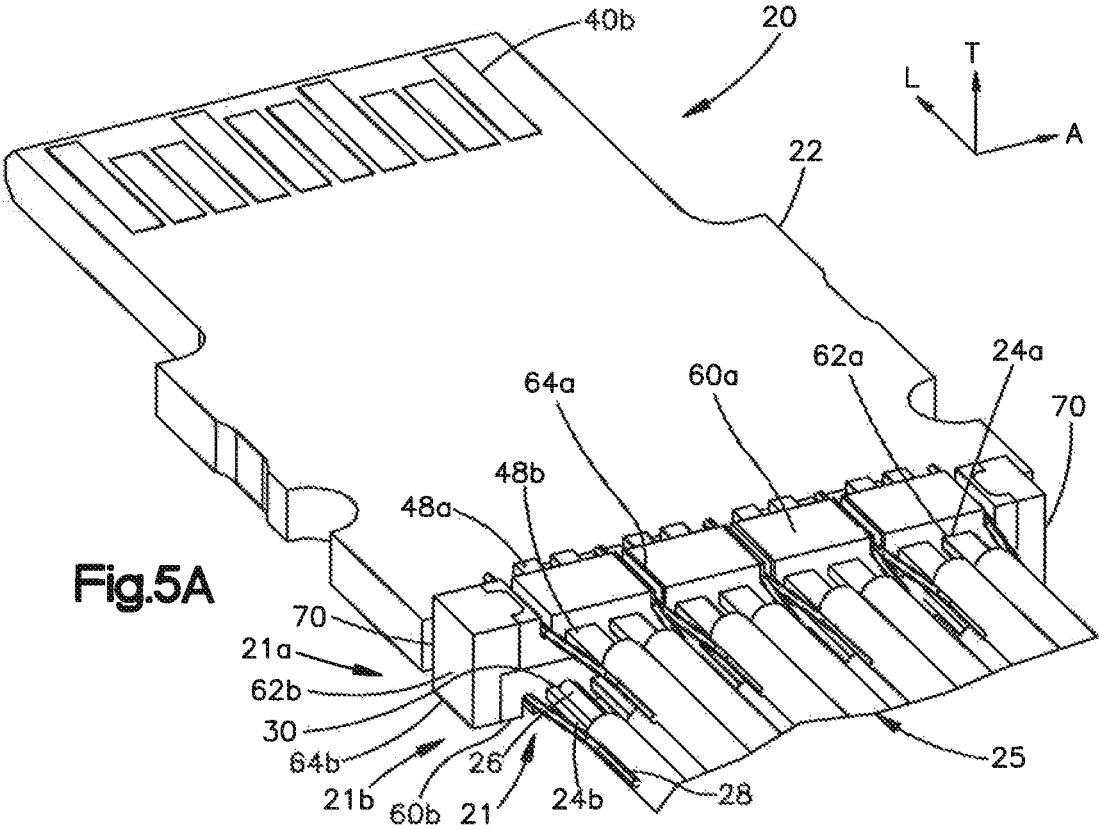
FIG. 5A is a perspective view of an electrical cable assembly as illustrated in FIG. 1A, but showing the electrical cables arranged in an alternative orientation.
Figure 5B:
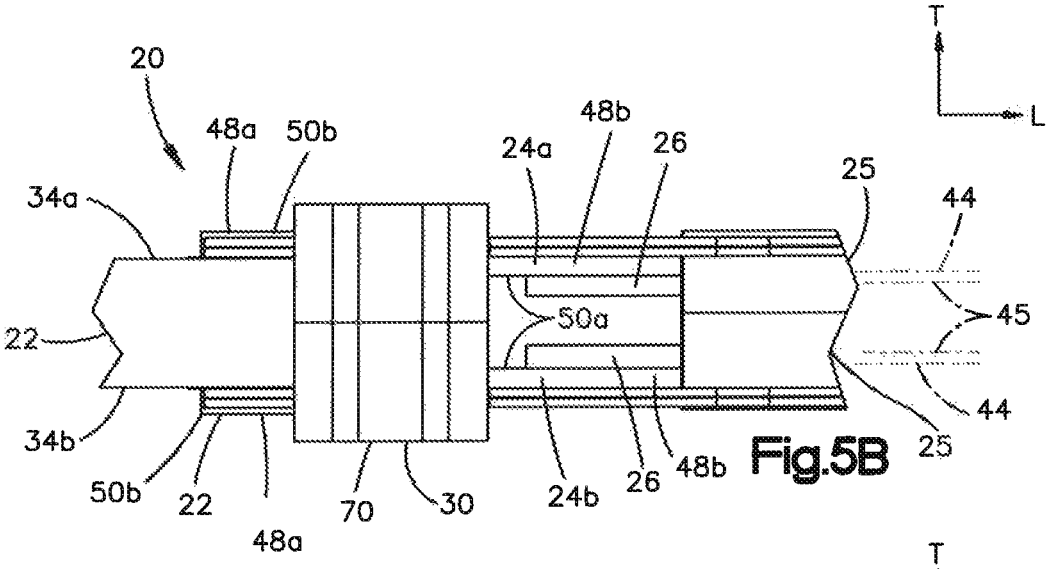
FIG. 5B is a side elevation view of the electrical cable assembly illustrated in FIG. 5A.
Figure 5C:
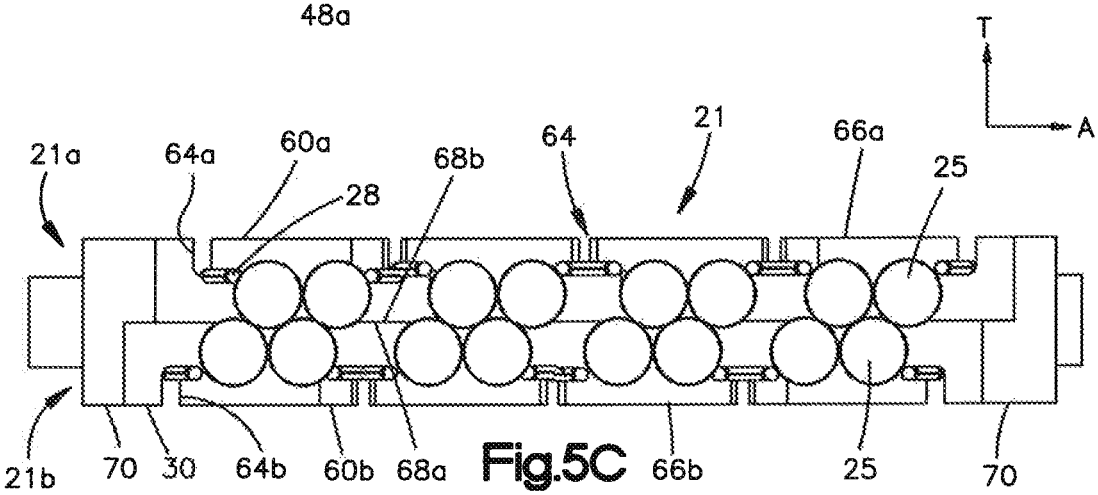
FIG. 5C is an end elevation view of the electrical cable assembly illustrated in FIG. 5A.
Figure 5D:
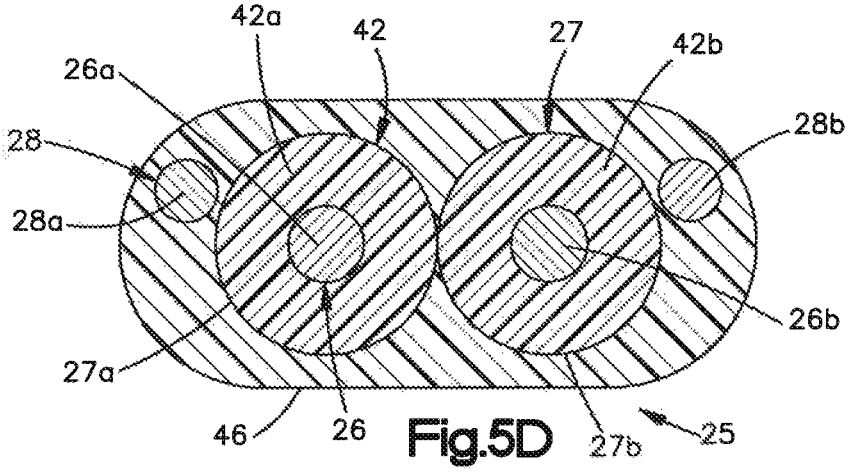
FIG. 5D is a representative one of the electrical cables of the electrical cable assembly illustrated in FIG. 5A.
Figure 6:
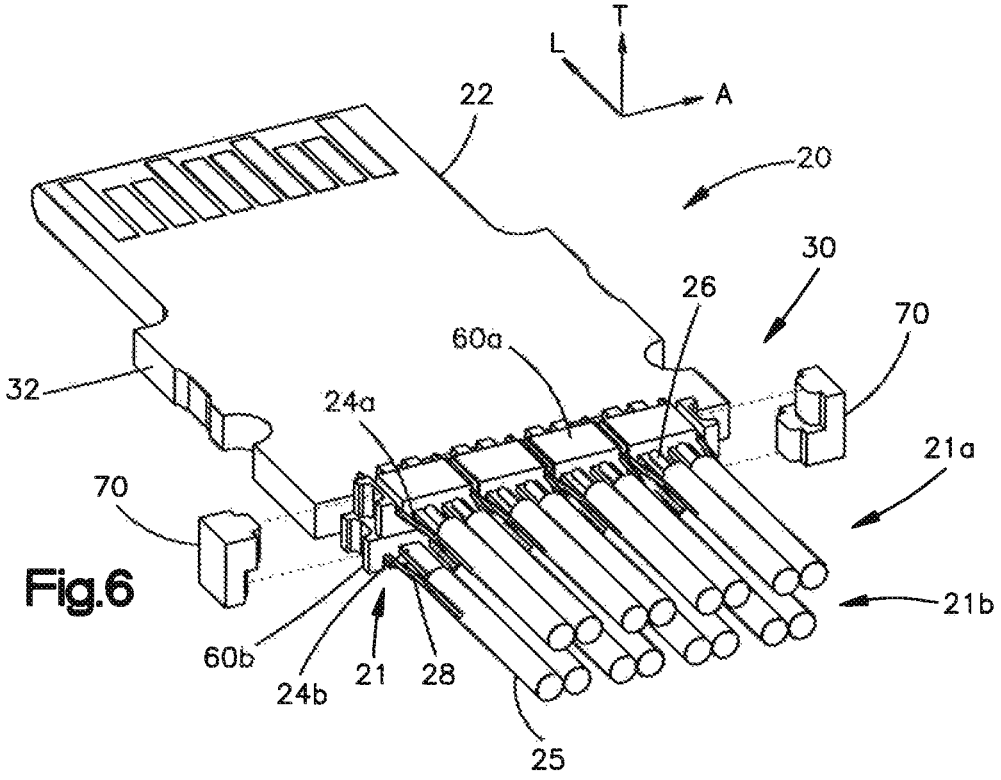
FIG. 6 is a perspective view of the electrical cable assembly of FIG. 1A, including an exploded perspective view of the alignment housing.
Figure 7A:
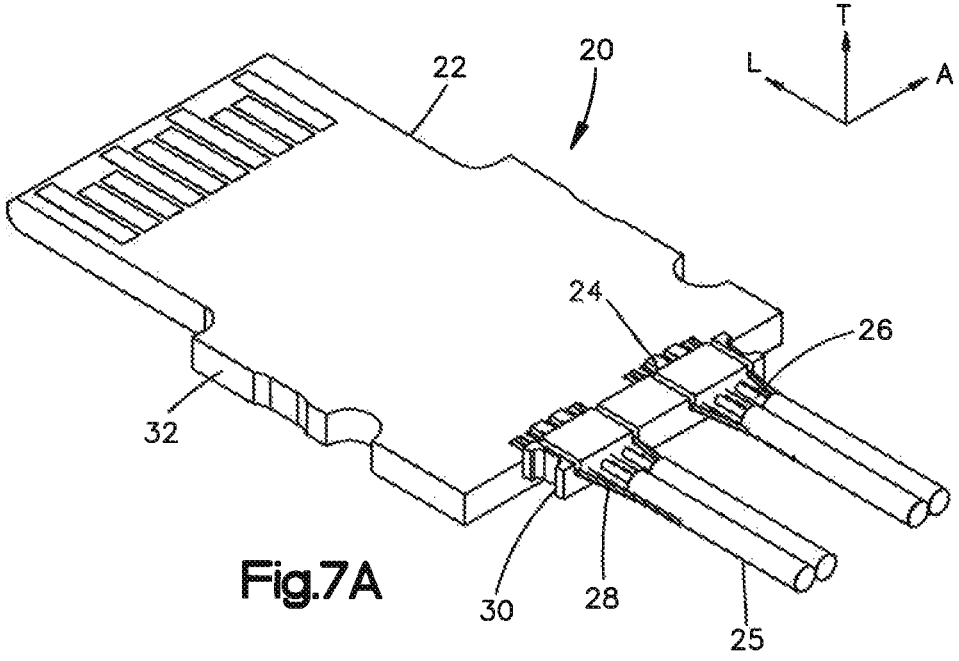
FIG. 7A is a perspective view of the electrical cable assembly of FIG. 1A, but constructed in accordance with an alternative embodiment.
Figure 7B:
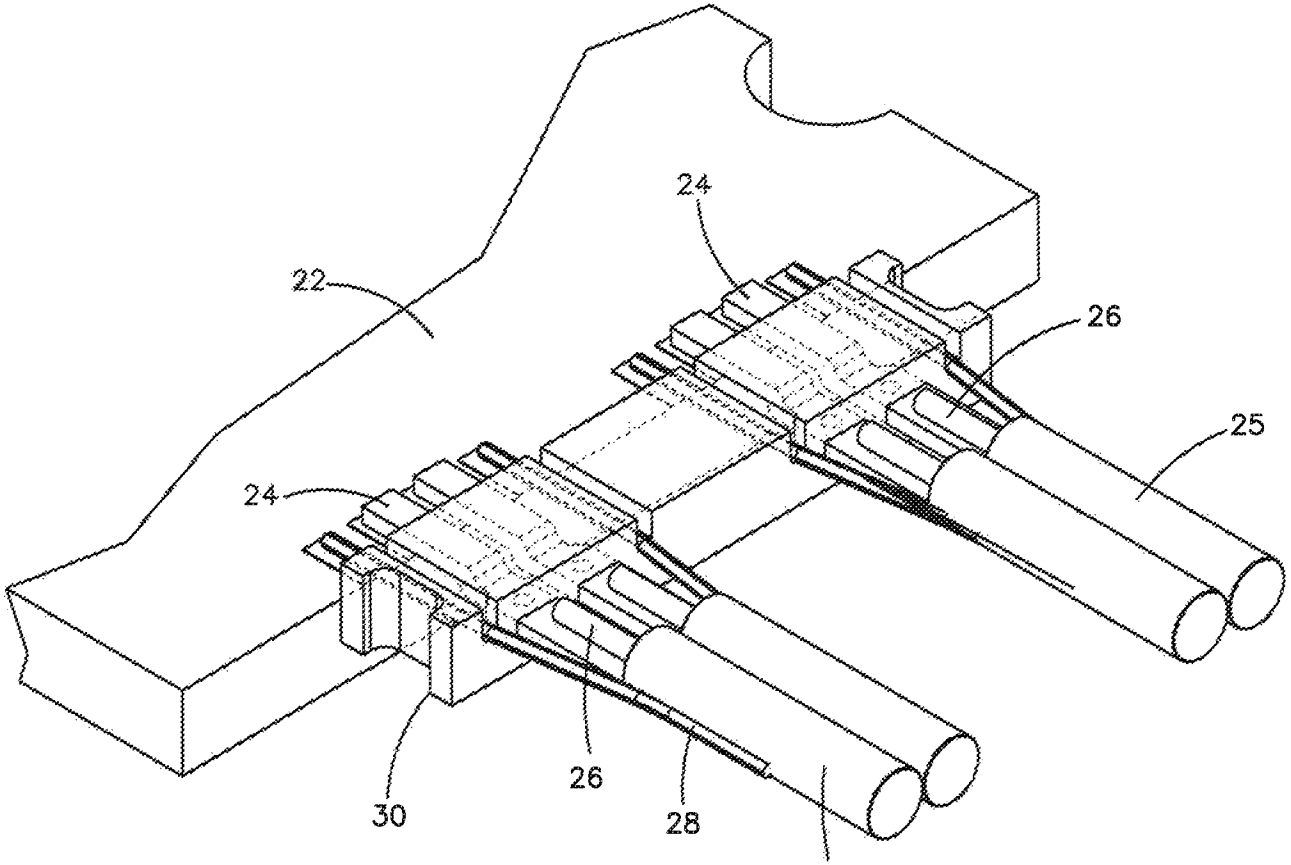
FIG. 7B is an enlarged perspective view of the electrical cable assembly illustrated in FIG. 7A.
Figure 8A:
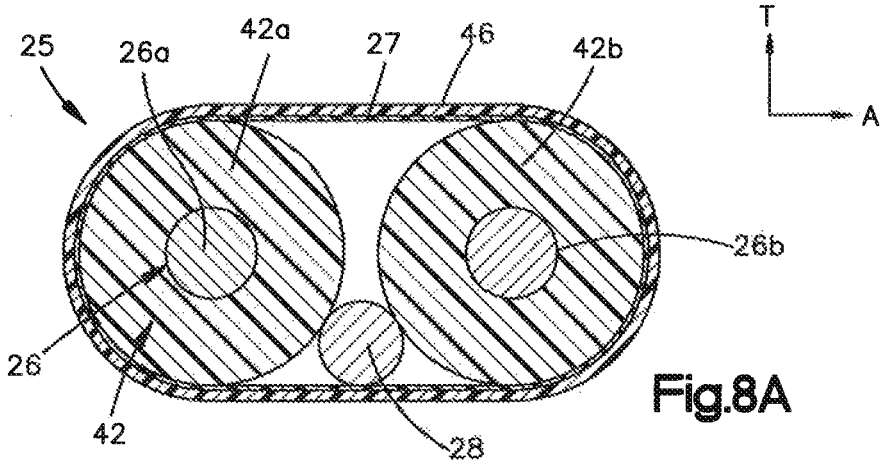
FIG. 8A is a sectional end elevation view of a representative one of the plurality of electrical cables illustrated in FIG. 1A, but constructed in accordance with an alternative embodiment.
Figure 8B:
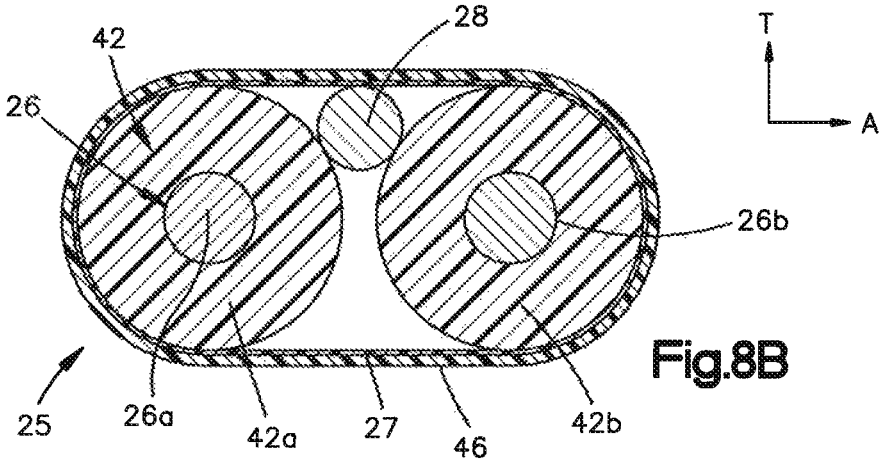
FIG. 8B is a sectional end elevation view of a representative one of the plurality of electrical cables illustrated in FIG. 1A, but constructed in accordance with another alternative embodiment.
Figure 8C:
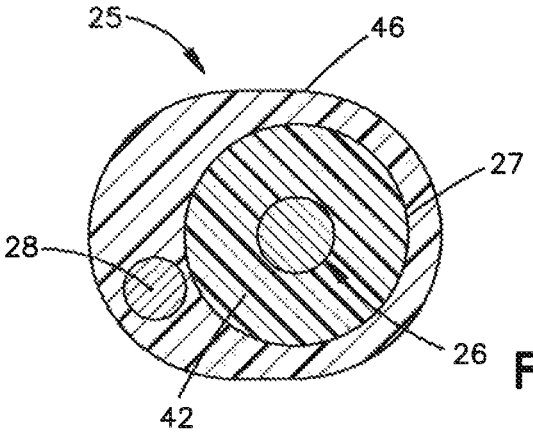
FIG. 8C is a sectional end elevation view of a representative one of the plurality of electrical cables illustrated in FIG. 1A, but constructed in accordance with another alternative embodiment.

Alternatively, referring now to FIGS. 7A-7B, the electrical cables 25 as illustrated in FIGS. 2 and 8A can be oriented in a second orientation as illustrated in FIGS. 5D and 8B, such that the central conductor axes 45 of the electrical conductors 26 of the first row 21*a* are spaced from the central conductor axes 45 of the electrical conductors 26 of the second row 21*b* a second distance that is fess than the first distance. The second distance can be measured along the transverse direction T. The second orientation can be 180 degrees offset with respect to the first orientation about an axis that is oriented along the longitudinal direction. When the electrical cables 25 are in the second orientation, the electrical conductors 26 can be offset in the transverse inward direction with respect to the drain wires 28. Thus, the central conductor axes 45 of the first and second rows 21*a* and 21*b* can be disposed between the central drain wire axes 44 of the first and second rows 21*a* and 21*b* with respect to the transverse direction T. For instance, the central drain wire axes 44 of the drain wires 28 of the first row 21*a* can be aligned in a first plane, the central drain wire axes 44 of the drain wires 28 of the second row 21*b* can be aligned in a second plane, the central conductor axes 45 of the electrical conductors 26 of the first row 21*a* can be aligned in a third plane, and the central conductor axes 45 of the electrical conductors 26 of the second row 21*b* can be aligned in a fourth plane. The third and fourth planes can be disposed between the first and second planes.

Referring now to FIGS. 5A-5D, each of the interposers 24 can define a first surface 50*a* and a second surface 50*b* opposite the first surface 50*a*. The first surface 50*a* at the first end 48*a* can define the first engagement surface that is configured to be mounted to the substrate 22 as described above. However, the second engagement surface can be defined by the first surface 50*a* at the second end 48*b*. As described above, the second engagement surface is configured to be mounted to a respective one of the electrical conductors 26. Thus, the second engagement surface can be configured to face the transverse inward direction toward the respective one of the electrical conductors 26. Thus, the second engagement surface is configured to face the respective one of the electrical conductors 26. The second engagement surface can be substantially planar. For instance, the second engagement surface can be substantially planar along a plane defined by the longitudinal direction L and the lateral direction A.

Accordingly, the first engagement surface can offset with respect to the second engagement surface along the transverse direction T. In particular, the second engagement surface can be offset with respect to the first engagement surface in the transverse inward direction. The offset can be any distance as desired. In one example, the first engagement surface is configured to be mounted to one of the first and second surfaces 34*a* and 34*b*, and the offset can be less than a distance from the one of the first and second surfaces 34*a* and 34*b* to the midplane of the substrate 22 along the transverse direction T. Thus, the offset can be less than one-half the thickness of the substrate 22.

As described above, the first row 21*a* of the electrical cable assemblies 21 can include first ones 24*a* of the interposers 24, and the second row 21*b* of the electrical cable assemblies 21 can include second ones 24*b* of the interposers 24. The first ones 24*a* of the interposers 24 are configured to be mounted to the first surface 34*a* of the substrate 22, for instance at the respective first engagement surfaces. The second ones 24*b* of the interposers 24 are configured to be mounted to the second surface 34*b* of the substrate 22, for instance at the respective first engagement surfaces. When the first and second ones 24*a* and 24*b* of the interposers 24 are mounted to the substrate 22, the transverse inward direction of the first engagement surfaces of the second ones 24*b* of the interposers 24 can be opposite the transverse inward direction of the first engagement surfaces of the second ones 24*a* of the interposers 24. Thus, the first engagement surfaces of the first ones 24*a* of the interposers 24 can face a first direction, and the first engagement surfaces of the second ones 24*b* of the interposers 24 can face a second direction opposite the first direction. The first and second directions can, for instance, extend toward each other from the respective first engagement surfaces. The transverse inward direction of the second engagement surfaces of the first ones 24*a* of the interposers 24 can be also be directed toward the transverse inward direction of the second engagement surfaces of the second ones 24*b* of the interposers 24. Thus, the second engagement surfaces of the first ones 24*a* of the interposers 24 can face the first direction, and the first engagement surfaces of the second ones 24*b* of the interposers 24 can face the second direction that is opposite the first direction.

While the interposers 24 have been described as configured to place the electrical conductors 26 in electrical communication with the substrate 22, it should be appreciated that alternatively or additionally, a plurality of the interposers 24 can be configured to be electrically connected between the substrate 22 and respective ones of the drain wires 28 of the plurality of electrical cables 25, thereby placing the drain wires 28 in electrical communication with the substrate 22 in the manner described above with respect to the electrical conductors 26.

Referring now to FIGS. 1A-6, and as described above, the electrical cable assembly 21, and thus the electrical system 20, can further include an electrically insulative or dielectric alignment housing 30 that is configured to align the interposers 24 and drain wires 28 with the respective ones of the first contact locations of the substrate 22. The first contact locations of the substrate 22 can include first ones 55*a* of the first contact locations, and second ones 55*b* of the first contact locations. The interposer 24 can be configured to be mounted to the first ones 55*a* of the first contact locations. Thus, the electrical conductors 26 can be configured to be placed in electrical communication with the first ones 55*a* of the first contact locations. The drain wires 28 can be configured to be mounted to the second ones 55*b* of the first contact locations.

The first and second ones 55*a* and 55*b* of the contact locations can be arranged as desired, depending for instance on the number of electrical conductors 26 and drain wires 28 included in each electrical cable 25. For instance, the substrate 22 can be configured such that pairs of the first ones 55*a* of the first contact locations can be disposed between adjacent ones of the second ones 55*b* of the first contact locations along the lateral direction A. Accordingly, when the electrical cable 25 includes first and second electrical conductors, first and second interposers 24 can be mounted to different ones of the pair of the first ones 55*a* of the first contact locations. The first and second ones of the first and second electrical conductors 26*a* and 26*b* can be mounted to respective ones of the first and second interposers 24 so as to place the first and second electrical conductors 26*a* and 26*b* with the different ones of the pair of the first ones 55*a* of the first contact locations. The first and second drain wires 28*a* and 28*b* can be mounted to different ones of the adjacent ones of the second ones 55*b* of the first contact locations.

Alternatively, the substrate 22 can be configured such that the first ones 55*a* of the first contact locations can be alternatingly arranged with the second ones 55*b* of the first contact locations along the lateral direction A. Accordingly, when each of the electrical cables 25 includes a single electrical conductor 26 and a single drain wire 28, the interposer 24 can be mounted to one of the first ones 55*a* of the first contact locations. Thus, when the electrical conductor 26 is mounted to the interposer 24, the electrical conductor 26 is placed in electrical communication with the one of the first ones 55*a* of the first contact locations. The drain wire 28 of the electrical cable 25 is configured to be mounted to a second one 55*b* of the first contact locations that is adjacent the first one 55*a* to which the electrical conductor 26 is placed in electrical communication. Thus, interposers 24 and drain wires 28 can be alternatingly arranged on the substrate 22 in the lateral direction.

The alignment housing 30 is configured to align the electrical conductors 26 with the respective ones of the interposers 24 that are mounted onto the respective first ones of the first contact locations of the substrate 22. The alignment housing 30 is configured to align the drain wires 28 with the respective second ones of the first contact locations of the substrate 22. In one example, the alignment housing 30 is configured to support the electrical conductors 26 and the drain wires 28 at a location between the substrate 22 and the electrically insulative layers 42 and 46. In one example, the alignment housing 30 can abut the front edge of the substrate 22.

For instance, the alignment housing 30 can include a housing body 60, a first plurality of conduits 62 that extend through the housing body 60, and a second plurality of conduits 64 that extend through the housing body 60. The alignment housing 30 is configured to support individual ones of the interposers 24 in respective ones of the first plurality of conduits 62. For instance, the first plurality of conduits 62 can be configured to receive the interposers 24. Alternatively, the alignment housing 30 can be overmolded onto the interposers. The alignment housing 30 is configured to support individual ones of the drain wires interposers 28 in respective ones of the second plurality of conduits 64. For instance, the second plurality of conduits 64 can be configured to receive the drain wires 28. Alternatively, the alignment housing 30 can be overmolded onto the drain wires 28.

The first plurality of conduits 62 can be aligned with respective ones of the contact pads 41 of the first ones 55*a* of the first contact locations. The second plurality of conduits 62 can be aligned with respective ones of the contact pads 41 of the second ones 55*b* of the first contact locations. The second plurality of conduits 64 can be open to an outer surface of the housing body 60 along a direction that is perpendicular to the longitudinal direction L. For instance, the second plurality of conduits 64 can be open to the outer surface of the housing body 60 along the transverse direction. The first plurality of conduits 62 are each sized such that the interposers 24 can extend entirely through the housing body 60 generally along the longitudinal direction L. Similarly, the second plurality of conduits 64 are each sized such that the drain wires 28 can extend entirely through the housing body 60 generally along the longitudinal direction L. At least one or more of the conduits can be configured as channels that are enclosed by the housing body 60 with respect to a plane that is normal to the central axis of the channels. Alternatively or additionally, at least one or more of the conduits can be recessed in the housing body 60.

In one example, the housing body 60 can define a first or front face 61*a*, and a second or rear face 61*b* opposite the front face with respect to the longitudinal direction L. The housing body 60 can define first ones 62*a* of the first plurality of conduits 62 arranged along the first row 21*a*, and the and second ones 62*b* of the first plurality of conduits 62 arranged along the second row 21*b*. Thus, the first ones 62*a* of the first plurality of conduits 62 are configured to receive respective first ones 24*a* of the interposers 24 that are configured to extend through the housing body 60, and thus through the alignment housing 30. Similarly, the second ones 62*b* of the first plurality of conduits 62 are configured to receive the second ones 24*b* of the interposers, such that the second ones 24*b* of the interposers 24 are configured to extend through the housing body 60, and thus through the housing 30. In particular, the transition regions 49 of the interposers 24 are configured to be retained by the alignment housing 30 between the front face 61*a* and the rear face 61*b*. In one example, the first ones 62*a* of the first plurality of conduits 62 can be staggered with respect to the second ones 62*b* of the first plurality of conduits 62. For instance, in this example, a line oriented in the transverse direction that passes through a central axis of one of the first ones 62*a* of the first plurality of conduits 62 does not also pass through a central axis of any of the second ones 62*b* of the first plurality of conduits 62. In one example, the interposers 24 can be overmolded by the alignment housing 30. For instance, the first group 24*a* of interposers 24 can be overmolded by the housing body 60. Similarly, the second group 24*b* of interposers 24 can be overmolded by the housing body 60. Alternatively, the first plurality of conduits 62 can be pre-existing, and the interposers 24 can be inserted into the respective ones of the first plurality of conduits 62.

The alignment housing 30 includes a first outer surface 66*a* and a second outer surface 66*b* opposite the first outer surface 66*a* along the transverse direction T. The second plurality of conduits 62 can each be recessed into the first and second outer surfaces 66*a* and 66*b*. For instance, first ones 64*a* of the second plurality of conduits 64 can extend into the first outer surface 66*a* along a direction toward the second outer surface 66*b*. Similarly, second ones 64*b* of the second plurality of conduits 64 can extend into the second outer surface 66*b* along a direction toward the first outer surface 66*a*. Each of the second plurality of conduits 64 can each extend through the housing body 60 from the front face 61*a* to the rear face 61*b*, and can each be sized to receive a respective one of more of the drain wires 28. For instance, the second plurality of conduits 64 can receive one of the drain wires 28, while others of the second plurality of conduits 64 can receive a pair of adjacent drain wires 28. For instance, the pair of adjacent drain wires 28 can be defined by a pair of adjacent electrical cables 25. In one example, the first ones 64*a* of the second plurality of conduits 64 can be staggered with respect to the second ones 64*b* of the second plurality of conduits 64. For instance, in this example, a line oriented in the transverse direction T that passes through a central axis of one of the first ones 64*a* of the second plurality of conduits 64 does not also pass through a central axis of any of the second ones 64*b* of the second plurality of conduits 64.

For instance, the drain wires 28 of the first row 21*a* can be inserted into respective ones of the first ones 64*a* of the second plurality of conduits, and mounted to the first surface 34*a* of the substrate 22 as described above. For instance, the drain wires 28 of the first row 21*a* can be soldered or otherwise mounted to the contact pads 41 of the second ones 55*b* of the first contact locations at the first surface 34*a*. Similarly, the drain wires 28 of the second row 21*b* can be inserted into respective ones of the second ones 64*b* of the second plurality of conduits 64, and mounted to the second surface 34*b* of the substrate 22 as described above. For instance, the drain wires 28 of the second row 21*b* can be soldered or otherwise mounted to the contact pads of the second ones of the first contact locations at the second surface 34*b*.

Further, the housing body 60 can include first and second body portions 60*a* and 60*b* that each defines respective portions of the front and rear faces 61*a* and 61*b*. The first body portion 60*a* can define the first ones 62*a* of the first plurality of conduits 62, and the second body portion 60*b* can define the second ones 62*b* of the first plurality of conduits 62. Further, the first body portion 60*a* can define the first outer surface 66*a* and the first ones 64*a* of the second plurality of conduits 64. Similarly, the second body portion 60*b* can define the second outer surface 66*b* and the second ones 64*b* of the second plurality of conduits 64.

The first body portion 60*a* defines a first inner surface 68*a* that is opposite the first outer surface 66*a* along the transverse direction T. For instance, the first inner surface can 68*a* can be spaced from the first outer surface 66*a* in the transverse inward direction. Similarly, the second body portion 60*b* defines a second inner surface 68*b* that is opposite the second outer surface 66*b* along the transverse direction. For instance, the second inner surface can 68*b* can be spaced from the second outer surface 66*b* in the transverse inward direction. The first and second body portions 60*a* and 60*b* are configured to be attached to each other. For instance, the first and second inner surfaces 68*a* and 68*b* can be configured to face each other when the first and second body portions 60*a* and 60*b* are attached to each other. In one example, the first and second inner surfaces 68*a* and 68*b* are configured to abut each other when the first and second body portions 60*a* and 60*b* are attached to each other. The alignment housing 30 further includes opposed attachment members 70 that are configured to secure the first and second body portions 60*a* and 60*b* to each other at their respective opposed ends along the lateral direction A.

To assembly the electrical system 20, the alignment housing 30 can be overmolded onto the respective first and second ones 24*a* and 24*b* of the interposers 24. For instance, the first body portion 60*a* can be overmolded onto the first ones 24*a* of the interposers 24, and the second body portion 60*b* can be overmolded onto the second ones 24*b* of the interposers 24. The opposed attachment members 70 can be attached to each of the first and second body portions 60*a* and 60*b* so as to secure the first body portion 60*a* to the second body portion 60*b*. The first ends 48*a* of the first ones 24*a* of interposers 24 can be mounted to the respective first ones of the first contact locations carried by the first surface 34*a* of the substrate 22. For instance, the first engagement surface of the first ends 48*a* can be soldered to the respective contact pads of the substrate. Similarly, the first ends 48*a* of the second ones 24*b* of interposers 24 can be mounted to the respective first ones of the first contact locations carried by the first surface 34*a* of the substrate 22. For instance, the first engagement surface of the first ends 48*a* can be soldered to the respective contact pads of the substrate 22.

The electrical conductors 26 of the first row 21*a* can be mounted onto the second ends 48*b* of respective ones of the first ones 24*a* of the interposers 24. For instance, the electrical conductors 26 of the first row 21*a* can be soldered to the second engagement surfaces of the respective ones of the first ones 24*a* of the interposers 24. Similarly, the electrical conductors 26 of the second row 21*b* can be mounted onto the second ends 48*b* of respective ones of the second ones 24*a* of the interposers 24. For instance, the electrical conductors 26 of the second row 21*b* can be soldered to the second engagement surfaces of the respective ones of the second ones 24*b* of the interposers 24. The drain wires 28 of the first row 21*a* can be placed into respective first ones 64*a* of the second plurality of conduits 64 and mounted to the respective second ones of the first contact locations carried by the first surface 34*a* of the substrate 22. The drain wires 28 of the second row 21*b* can be placed into respective second ones 64*b* of the second plurality of conduits 64 and mounted to the second ones of the first contact locations carried by the second surface 34*b* of the substrate 22.

It should be appreciated that the above method steps can be performed in any order as desired. For instance, the electrical conductors 26 can be mounted to the interposers 24 before or after the interposers 24 are mounted to the substrate. Further, the drain wires 28 can be mounted to the substrate 22 before or after the electrical conductors 26 are mounted to the interposers 24. Further still, the drain wires 28 can be mounted to the substrate 22 before or after the interposers 24 are mounted to the substrate. Further still, the drain wires 28 can be mounted to the substrate 22 before or after the drain wires are placed into the respective second plurality of conduits 64. A method for assembling the electrical system 20 can further include the steps of teaching to a third party any one or more up to all of the method steps above in any combination, and selling the cable assembly to the third party.

Referring now to FIGS. 7A-7B, the alignment housing 30 can include any number of first and second conduits 62 and 64 as desired, such that the electrical system 20 can include any corresponding number of electrical cables 25 as desired. In one example, the alignment housing 30 can include a sufficient number of first and second conduits so as to support a pair of electrical cables 25. Each of the electrical cables 25 can include first and second electrical conductors 26, and first and second drain wires 28*a* and 28*b*, respectively. Thus, the alignment housing 30 can include four first conduits 62 and four second conduits 64. It should be further appreciated that the alignment housing 30 can define one single unitary body, and all of the first conduits 62 can extend along a single row that is oriented along the lateral direction A. Similarly, all of the second conduits 64 can extend along a single row that is oriented along the lateral direction A. Thus, the electrical cables 25 can be arranged in a single row oriented along the lateral direction. It should be understood that certain of the drawings, including FIGS. 7A-7B, show the electrical cables 25 without the ground jacket 27 and the exterior electrically insulative layer 46 for illustration purposes only.

It should be appreciated that offset between the first and second ends 48*a* and 48*b* of the interposers 24 along the transverse direction T provides for a lower profile design than conventional electrical systems. The bundle profile of the electrical cables 25 can further be reduced due to the nesting of the electrical cables 25 of the first row 21*a* with the electrical cables 25 of the second row 21*b*. Further, because the interposers 24 can be overmolded by the alignment housing 30 at the same pitch as the contact pads 41 of the substrate 22 along the lateral direction A, assembly of the electrical system 20 can be easily automated. Additionally, the pitch of the electrical cables 25 are not associated with the pitch of the contact pads 41, so long as the electrical conductors are mountable onto the interposers 24 and the drain wires 28 can be inserted into the second conduits 64. Moreover, the interposers 24 are interlocked in the alignment housings 30, thereby providing strain relief for the connection at the substrate 22. Furthermore, the wire termination area at the respective contact locations of the substrate 22 can be reduced with respect to the longitudinal direction relative to conventional electrical systems. Further still, the interposer 24 can include various transitions such as radii, voids, width, length, and thickness can partially determine the value of the corresponding characteristic impedance. The interaction of surrounding dielectric material with the interposer 24 can also partially determine impedance. Accordingly, it should be appreciated that geometric characteristics of the interposer 24 can be controlled so as to correspondingly tune impedance.

Although the disclosure has been described in detail, it should be understood that various changes, substitutions, and alterations can be made herein without departing from the spirit and scope of the invention as defined by the appended claims. Moreover, the scope of the present disclosure is not intended to be limited to the particular embodiments described in the specification. As one of ordinary skill in the art will readily appreciate from that processes, machines, manufacture, composition of matter, means, methods, or steps, presently existing or later to be developed that perform substantially the same function or achieve substantially the same result as the corresponding embodiments described herein may be utilized according to the present disclosure.

What is claimed:

1. An electrical cable assembly comprising:

at least one electrical cable including at least one electrical conductor, at least one electrically conductive shield that at least partially surrounds at least a length of the at least one electrical conductor, and at least one drain wire that extends out from the at least one electrically conductive jacket; and at least one electrically conductive terminal having a first end that is configured to be mounted to a substrate, and a second end offset from the first end along a longitudinal direction, the second end configured to be mounted to the electrical conductor, wherein the at least one electrically conductive terminal comprises an offset between the first and second ends along a transverse direction that is substantially perpendicular to the longitudinal direction.

2. The electrical cable assembly of claim 1, wherein the substrate comprises:

at least one ground pad and at least one insulator supporting the at least one electrically conductive terminal; and an electrically conductive member, supported by the insulator, coupling the shield to the ground pad.

3. The electrical cable assembly of claim 1, wherein the second end of the at least one electrically conductive terminal is connected to the first end of the at least one electrically conductive terminal by an intermediate region, wherein the intermediate region comprises at least one bend.

4. The electrical cable assembly of claim 1, wherein the at least one electrically conductive terminal is a first width at the first end along the lateral direction that is substantially perpendicular to each of the longitudinal direction and the transverse direction, and a second width at the second end along the lateral direction that is greater than the first width.

5. The electrical cable assembly of claim 1, further comprising at least one housing to support the at least one electrically conductive terminal.

6. A cable assembly comprising:

a cable, wherein the cable comprises a conductor and a conductive shield;

a paddle card, wherein the paddle card comprises:

a mating end configured to mate with an electrical component;

a first surface and an electrically conductive contact on the first surface, wherein the electrically conductive contact is separated from the mating end along a longitudinal direction;

a conductive terminal comprising a first end connected to the electrically conductive contact and a second end offset from the first end in a transverse direction, wherein the conductor of the cable is connected to the second end of the conductive terminal.

7. The electrical cable assembly of claim 6, further comprising an insulative housing wherein the electrically conductive terminal is supported in the insulative housing.

8. The electrical cable assembly of claim 7, wherein the first ends of the conductive terminal extend along a first direction from the insulative housing and the second end of the electrically conductive terminal extend along a second direction from the insulative housing, wherein the second direction is opposite the first direction.

9. The cable assembly of claim 7, wherein:

the conductive terminal is a first conductive terminal;

the cable assembly further comprises a second conductive terminal, wherein the second conductive terminal is supported in the insulative housing, such that the second conductive terminal is adjacent the first conductive terminal.

10. The cable assembly of claim 9, wherein:

the conductor is a first conductor of the cable;

the cable further comprises a second conductor, wherein the conductive shield encircles the first conductor and the second conductor; and the second conductor is connected to the second conductive terminal.

11. The cable assembly of claim 10, wherein:

the electrically conductive contact is a first contact;

the cable assembly further comprises a plurality of contacts, wherein a second contact of the plurality of contacts is adjacent to the first contact; and the second conductive terminal is connected to the second contact.

12. The cable assembly of claim 7, wherein the insulative housing is configured to align the electrically conductive terminal with the electrically conductive contact on the first surface.

13. The cable assembly of claim 6, wherein the conductive shield at least partially surrounds a length of the electrical conductor.

14. The cable assembly of claim 13, further comprising a ground pad and an electrically conductive member, supported by the insulative housing, coupling the conductive shield to the ground pad.

15. The cable assembly of claim 6, wherein the conductive terminal is connected to the conductive contact using solder.

16. A cable assembly comprising:

a plurality of electrical cables, wherein the electrical cables comprise at least one electrical conductor and a conductive shield;

a paddle card, wherein the paddle card comprises:

a mating end configured to mate with an electrical component;

a first surface;

a plurality of electrically conductive pads on the first surface of the paddle card and separated from the mating end along a longitudinal direction; and a second surface separated from the first surface along a transverse direction, wherein the second surface comprises a second plurality of electrically conductive contacts separated from the mating end along a longitudinal direction;

an insulative housing; and a plurality of electrically conductive terminals supported by the insulative housing, each of the plurality of electrically conductive terminals comprising a first end and a second end, wherein the first end is connected to a pad of the plurality of electrically conductive pads and an electrical conductor of the at least one electrical conductors of the plurality of electrical cables is connected to the second end.

17. The cable assembly of claim 16, further comprising a ground member supported by the insulative housing, wherein the ground member couples the electrically conductive shield of a cable of the plurality of cables to a respective pad of the plurality of electrically conductive pads of the paddle card.

18. The cable assembly of claim 16, wherein the plurality of electrically conductive terminals is arranged in a plurality of rows, wherein each row is arranged along the lateral direction.

19. The cable assembly of claim 18, wherein a first row of the plurality of rows is configured at a first position on the paddle card, wherein the first position is a first distance from a side edge of the paddle card, and a second row of the plurality of rows is configured at a second position on the paddle card, wherein the second position is a second distance from a side edge of the paddle card, such that the second row is offset from the first row along a lateral direction.

20. The cable assembly of claim 16, wherein the plurality of electrically conductive terminals is configured in pairs of conductive terminals.

21. The cable assembly of claim 20, wherein the pairs of conductive terminals comprise:

a first conductive terminal; and a second conductive terminal, wherein the second conductive terminal is supported by the insulative housing, such that the second conductive terminal is adjacent to the first conductive terminal.

22. The cable assembly of claim 21, wherein:

the plurality of electrically conductive pads is configured in pairs, such that the first conductive terminal is connected to a first electrically conductive pad, and the second conductive terminal is connected to a second electrically conductive pad, such that the second electrically conductive pad is adjacent the first electrically conductive pad.

23. The cable assembly of claim 22, wherein:

the pairs of conductive terminals are arranged in a plurality of rows comprising:

a first pair of conductive terminals mounted to the paddle card; and a second pair of conductive terminals mounted to the paddle card, wherein the second pair of conductive terminals separated from the first pair of conductive terminals along a lateral direction.

24. The cable assembly of claim 16, wherein at least one conductive terminal of the plurality of electrically conductive terminals is a first width at the first end along the lateral direction that is substantially perpendicular to each of the longitudinal direction and the transverse direction, and a second width at the second end along the lateral direction that is greater than the first width.

25. The cable assembly of claim 16, wherein the insulative housing is configured to align the first end of the electrically conductive terminal with a pad of the plurality of electrically conductive pads.

* * * * *